US008955503B2

(12) United States Patent
Corsiglia et al.

(10) Patent No.: US 8,955,503 B2
(45) Date of Patent: Feb. 17, 2015

(54) TOY PROJECTILE LAUNCHER AND PROJECTILE THEREOF

(75) Inventors: Jeffrey James Corsiglia, Sooke (CA); Anne Pitrone, Tenafly, NJ (US); Rodney B. Schmelter, Etobicoke (CA)

(73) Assignee: Spin Master Ltd., Toronto (CA)

( * ) Notice: Subject to any disclaimer, the term of this patent is extended or adjusted under 35 U.S.C. 154(b) by 594 days.

(21) Appl. No.: 13/288,484

(22) Filed: Nov. 3, 2011

(65) Prior Publication Data

US 2013/0112184 A1 May 9, 2013

(51) Int. Cl.
*F41B 4/00* (2006.01)
*A63B 69/40* (2006.01)
*F42B 6/00* (2006.01)

(52) U.S. Cl.
CPC ..... *F42B 6/00* (2013.01); *A63B 69/406* (2013.01); *F41B 4/00* (2013.01)
USPC ..... 124/78

(58) Field of Classification Search
CPC ..... F41B 4/00; A63B 69/406
USPC ..... 124/6, 10, 32, 51.1, 78, 81
See application file for complete search history.

(56) References Cited

U.S. PATENT DOCUMENTS 3,548,801 A * 12/1970 Lewis et al. ..... 124/6
4,325,351 A * 4/1982 Yuasa ..... 124/78
4,672,942 A * 6/1987 Steward ..... 124/1
4,875,459 A 10/1989 Van Elderen et al.
5,396,876 A * 3/1995 Liscio et al. ..... 124/6
5,471,967 A * 12/1995 Matsuzaki et al. ..... 124/6
5,611,321 A * 3/1997 Hoeting et al. ..... 124/6
5,611,322 A * 3/1997 Matsuzaki et al. ..... 124/6
5,735,256 A * 4/1998 Monk ..... 124/65
5,782,228 A * 7/1998 Wu ..... 124/6
5,865,161 A * 2/1999 Bruce ..... 124/78
5,947,101 A * 9/1999 Kerr ..... 124/78
5,996,564 A * 12/1999 Kotowski ..... 124/6
6,024,078 A * 2/2000 Hollis et al. ..... 124/78
6,116,229 A * 9/2000 Wu ..... 124/6
6,244,260 B1 * 6/2001 Ragoza et al. ..... 124/34
6,523,535 B2 * 2/2003 Rehkemper et al. ..... 124/78
6,915,793 B2 * 7/2005 Vanek et al. ..... 124/78
7,051,727 B2 * 5/2006 Wu ..... 124/6
7,063,082 B2 * 6/2006 Vanek et al. ..... 124/78
7,163,009 B2 * 1/2007 Brown et al. ..... 124/76
7,673,624 B2 * 3/2010 Rosella, Jr. ..... 124/10
7,748,368 B2 7/2010 Forti
2002/0134366 A1 * 9/2002 Rehkemper et al. ..... 124/78
2005/0074277 A1 * 4/2005 Brown et al. ..... 403/79

* cited by examiner

*Primary Examiner* — Gene Kim
*Assistant Examiner* — Alexander Niconovich
(74) *Attorney, Agent, or Firm* — Harris Beach PLLC

(57) ABSTRACT

A toy projectile launcher includes a body having a magazine for storing at least one cylindrical projectile. The body has an elongate barrel in communication with the magazine. The barrel is shaped for travel of the projectile from the magazine to an exit end. The barrel has an intermediate opening between the magazine and the exit end. A drive wheel is powered by a motor to spin about an axis of rotation. The drive wheel can be coupled to the body by a drive wheel biasing member. The drive wheel intrudes into the barrel though the intermediate opening to contact and propel the projectile down the barrel. The drive wheel can include a resilient part. The axis of rotation of the drive wheel can deviate from being perpendicular to the length of the barrel by a predetermined angle selected to impart spin to the projectile.

12 Claims, 9 Drawing Sheets

TOY PROJECTILE LAUNCHER AND PROJECTILE THEREOF

FIELD OF THE INVENTION

This disclosure relates to toys, and more particularly, to a toy projectile launcher, a toy projectile, and a method of making the toy projectile.

BACKGROUND OF THE INVENTION

Toy projectile launchers are generally known and can be used for entertainment and gaming. Toy projectile launchers are known to use various propulsion technologies. Pneumatic launchers use a burst of air to propel a projectile forward. Mechanical launchers typically have a mechanism that exerts a mechanical impulse to launch a projectile. Other launching techniques exist as well. Known toy projectile launchers can suffer from limited range and accuracy. Some known projectile launchers use opposing twin drive wheels in opposition. These require either two motors or a geared connection, resulting in relatively high cost.

SUMMARY OF THE INVENTION

In one aspect, the invention is directed to a toy projectile launcher that includes a drive wheel having a resilient part and further includes a drive wheel biasing member that couples the drive wheel to a body of the launcher. The drive wheel biasing member can position the drive wheel to cause the resilient part of the drive wheel to intrude into a barrel of the launcher to contact and propel the projectile down the barrel. An axis of rotation of the drive wheel can be made to deviate from being perpendicular to the length of the barrel by an angle so as to impart spin to the projectile. The projectile can be made of a weighted hollow cylinder and can have a resilient cap at a fore end.

In an embodiment of the first aspect, a toy projectile launcher is provided, which includes a body having a magazine for storing at least one projectile. The body has an elongate barrel in communication with the magazine. The barrel is shaped for travel of the projectile from the magazine to an exit end of the barrel. The barrel has an intermediate opening between the magazine and the exit end. The toy projectile launcher further includes a drive assembly having a motor and a drive wheel coupled to the motor. The drive wheel has a resilient part. The toy projectile launcher also includes a drive wheel biasing member that couples the drive assembly to the body. The drive wheel biasing member positions the drive wheel to cause the resilient part of the drive wheel to intrude into the barrel though the intermediate opening to contact and propel the projectile down the barrel.

The drive wheel biasing member can be pivotally connected to the body between a first portion of the drive wheel biasing member that is coupled to the drive assembly and a second portion of the drive wheel biasing member that contacts a protrusion on the body.

The toy projectile launcher can further include one or more non-driven wheels opposite the drive wheel.

An axis of rotation of the drive wheel can deviate from being perpendicular to the length of the barrel by a predetermined angle.

The motor can be directly connected to the drive wheel.

The motor can be the only motor provided.

The resilient part of the drive wheel can conform to the shape of the projectile when in contact with the projectile.

The toy projectile launcher can further include a trigger coupled to the body, the trigger being movable to bring a hammer into contact with the projectile to push the projectile into contact with the drive wheel.

The toy projectile launcher can further include a switch coupled to the trigger, the switch being for supplying power to the motor when the trigger is pulled.

The toy projectile launcher can further include a magazine feed member coupled to the body, the magazine feed member being biased to urge projectiles towards the barrel.

In another aspect, the invention is directed to a toy projectile launcher that includes a body having a magazine for storing at least one cylindrical projectile having a central axis. The body has an elongate barrel in communication with the magazine. The barrel is shaped for travel of the projectile from the magazine to an exit end of the barrel. The barrel has an intermediate opening between the magazine and the exit end. The toy projectile launcher further includes a motor coupled to the body and a drive wheel coupled to the motor. An axis of rotation of the drive wheel deviates from being perpendicular to the length of the barrel by a predetermined angle. The drive wheel intrudes into the barrel though the intermediate opening to contact and propel the projectile down the barrel. The predetermined angle is selected to impart spin to the projectile about the central axis.

The toy projectile launcher can further include a drive wheel biasing member that couples the motor and drive wheel to the body, the drive wheel biasing member biasing the drive wheel into contact with the projectile.

The drive wheel can include a resilient part for contacting the projectile. The resilient part of the wheel may expand when spun, and deform, causing greater conformity with the projectile, reducing slip.

In another aspect, the invention is directed to a toy projectile that includes a hollow body, a weight disposed inside the hollow body at a fore end of the hollow body, and a soft, and preferably resilient, fore cap at the fore end of the hollow cylindrical part.

The hollow cylindrical part can include an extruded tube.

The toy projectile can further include an aft cap at an aft end of the hollow cylindrical part.

The toy projectile can further include a stem that connects the aft cap to the weight, and the fore cap can also be connected to the weight.

The fore cap, weight, stem, and aft cap can be portions of a single piece of material.

The resilient fore cap can be made of foam.

In another aspect, the invention is directed to a method of making a toy projectile includes cutting a section from an extruded tube, fitting a weight into a fore end of the section of tube, and plugging the fore end of the section of tube with a resilient fore cap.

The method can further include plugging an aft end of the section of tube with an aft cap.

The method can further include cutting the resilient fore cap from foam stock.

BRIEF DESCRIPTION OF THE DRAWINGS

The drawings illustrate, by way of example only, embodiments of the present disclosure.

DETAILED DESCRIPTION OF THE INVENTION

A toy projectile launcher, a toy projectile, and a method of making a toy projectile are described herein. The term "toy" is not meant to limit the applicability of this disclosure to children's toys. For example, this disclosure is also applicable to gaming or sporting activities in which adults might choose to participate.

Figure 1:
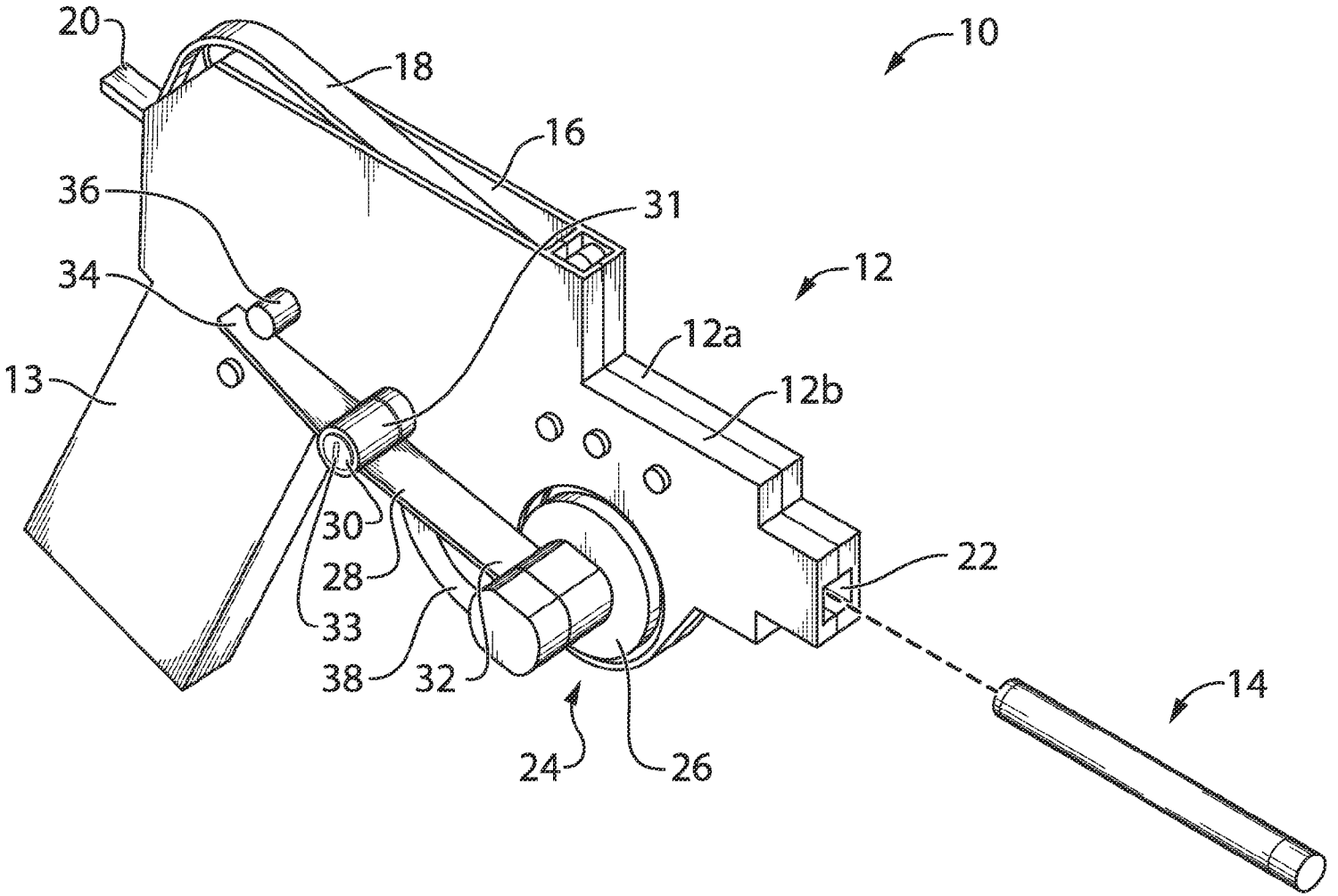
FIG. 1 is a perspective view of a toy projectile launcher.

FIG. 1 illustrates the toy projectile launcher 10. The toy projectile launcher 10 may also be known as a toy gun or mini-gun. The toy projectile launcher 10 includes a body 12. In this example, the body 12 is composed of two complementary portions 12*a* and 12*b* that can be fastened to together by screws, for example. A handle portion 13 of the body 12 can be shaped and textured to allow for easy and secure gripping by a person's hand. The body 12 can be made of plastic or other material. The exterior of the body 12 can be ornamentally shaped. The two complementary body portions 12*a* and 12*b* are merely one example of a construction technique that can be used.

The toy projectile launcher 10 launches cylindrical projectiles 14, which can be loaded into the body 12 via a magazine opening 16 after lifting a magazine feed member 18 using a thumb lever 20, which can be given a texture to allow easy actuation by a thumb. When launched, the projectiles 14 exit the body 12 though an opening at the exit end 22 of a barrel.

The toy projectile launcher 10 include a drive assembly 24 for propelling the projectile 14 out of the launcher 10. In this example, the drive assembly 24 includes a motor (ref. 42 of FIG. 2) and a drive wheel 26 coupled to the motor. The drive assembly 24 can be coupled to the body 12 by a drive wheel biasing member 28.

In this example, the drive wheel biasing member 28 is a resilient arm that is pivotally connected to the body portion 12*b* about a biasing member pivot point 33 via a sleeve 31 that is supported on a post 30 extending from body portion 12*b*. A first end 32 of the drive wheel biasing member 28 is coupled to the drive assembly 24, and a second end 34 of the drive wheel biasing member 28 engages a limit surface 37 on a protrusion 36 extending from the body portion 12*b*. The drive wheel biasing member 28 may be made from any sufficiently resilient material, such as certain types of plastic, for example.

A trigger 38 extends from the body 12 in front of the handle portion 13. When the trigger 38 is pulled, the next available projectile 14 in the magazine is launched.

Figure 2:
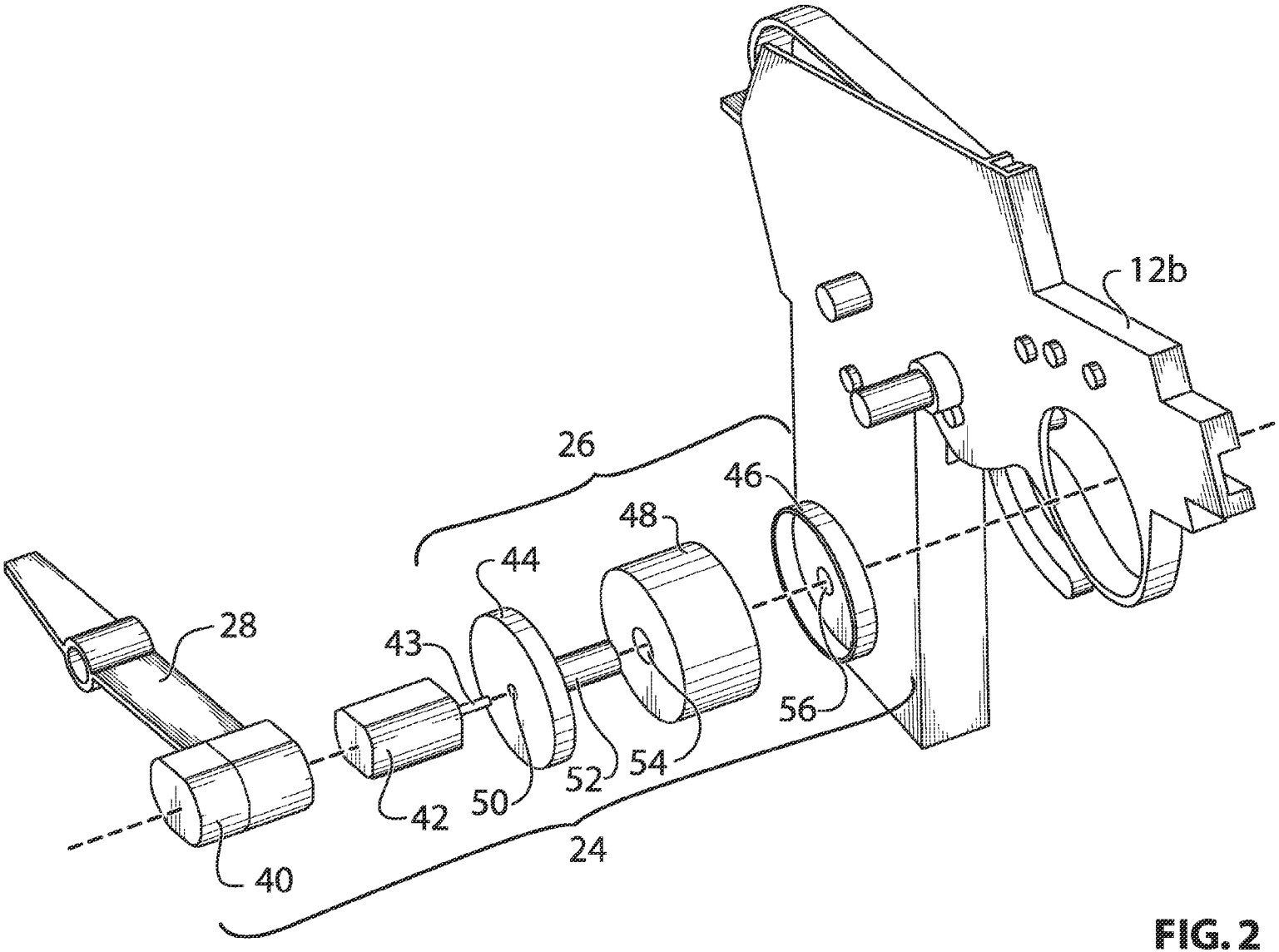
FIG. 2 is an exploded perspective view of a portion of the toy projectile launcher.

FIG. 2 shows the drive assembly 24 disassembled and the drive wheel biasing member 28 detached from the body portion 12*b*.

The drive assembly 24 can include a motor housing 40 that is fixed to the drive wheel biasing member 28. In one example, the motor housing 40 and the drive wheel biasing member 28 are of unitary construction and, for example, can be injection molded as a single piece of plastic.

The motor 42 can be an electric DC motor, such as the kind frequently used in the toy industry. In this example, the motor 42 is the only motor used in the toy projectile launcher 10. A shaft 43 of the motor 42 can be directly connected to the drive wheel 26.

The drive wheel 26 can include a pair of complementary cup-shaped rims 44 and 46 that fit together to sandwich a cylindrical resilient part 48. The rim 44 includes a hole 50 that mates with the shaft 43 of the motor 42. The hole 50 can be keyed or non-circular to fit the like-shaped shaft 43, or the shaft 43 can be friction-fit into the hole 50. The rim 44 further has a shaft 52 that extends through a hole 54 in the resilient part 48 and mates with a feature 56, such as a recess or protrusion, on the rim 46. The rims 44 and 46 can be made of plastic. In this example, the drive wheel 26 is the only drive wheel used in the toy projectile launcher 10.

The cylindrical resilient part 48 is made of resilient material, such as plastic foam (e.g., polyethylene, polypropylene, or polyurethane foam). Other materials can alternatively be used. The resilient part 48 substantially regains its shape after being subject to a deforming force. In another example, the resilient part is a layer of resilient material applied to the cylindrical surface of a hard plastic cylinder.

Figure 3:
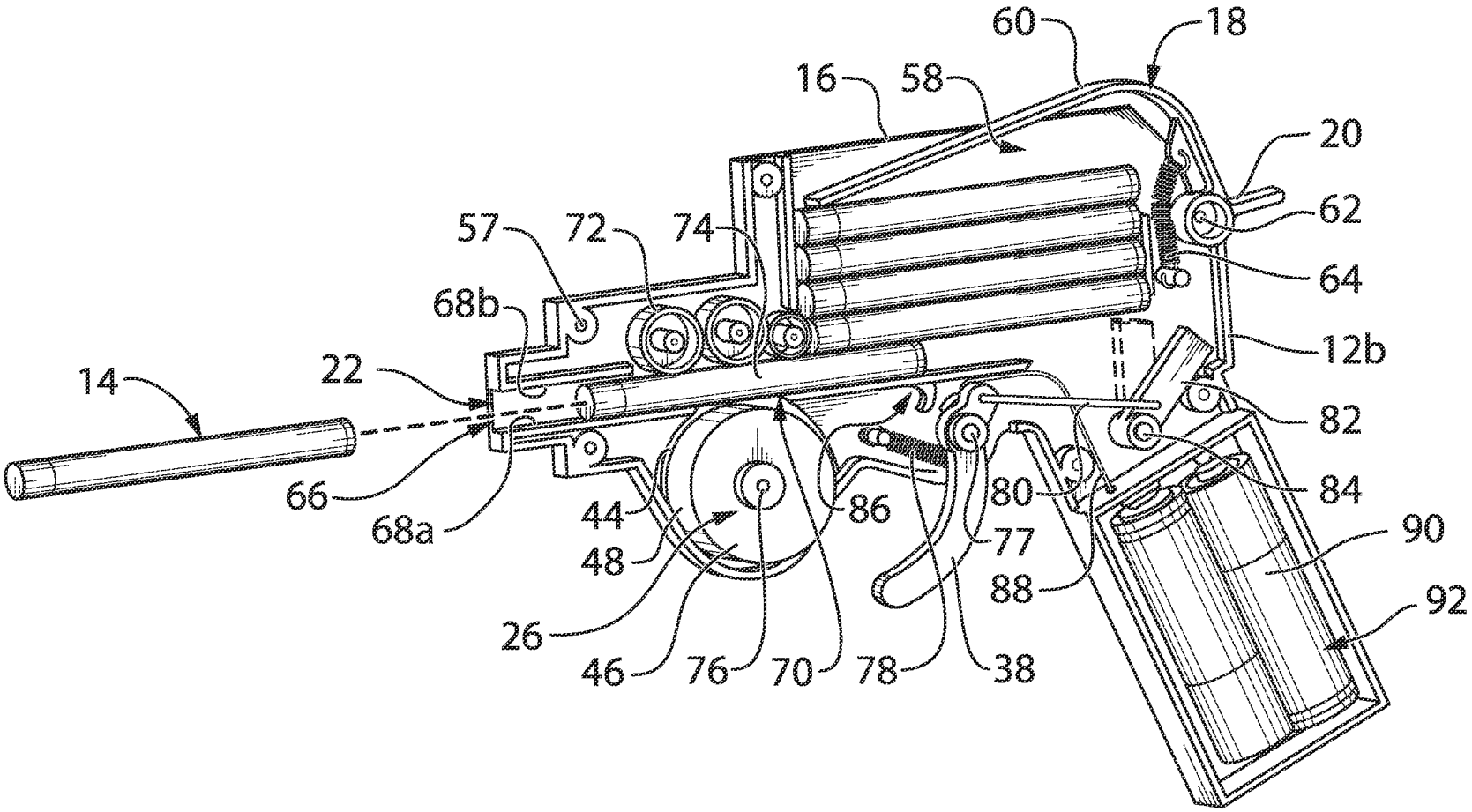
FIG. 3 is perspective view of the interior of the toy projectile launcher.

FIG. 3 shows the interior of the toy projectile launcher 10. In this view, the body portion 12*a* has been removed to expose the interior-facing side of the body portion 12*b*. Screw holes 57 can be provided in the body portion 12*b* to receive screws that hold the body portions 12*a* and 12*b* together.

Cylindrical projectiles 14 can be stored in a magazine 58 after being inserted into the magazine opening 16. The magazine feed member 18, in this example, includes an elongate arm 60 that is pivotally connected to the body 12 at pivot point 62. Pressing the thumb lever 20, which extends from the pivot point 62 opposite the arm 60, causes the arm 60 to lift and allow more projectiles 14 to be inserted into the magazine 58 through the opening 16. A spring 64 connecting the arm 60 to the body portion 12*b* biases the arm 60 into contact with the top-most projectile 14 and urges projectiles 14 towards the barrel 66.

The elongate barrel 66 starts at the magazine 58 and ends at the exit end 22. The barrel 66 is in communication with the magazine 58 from which projectiles 14 are fed to the barrel 66. The barrel 66 is generally shaped for travel of a projectile 14 from the magazine 58 to the exit end 22. In this example, the barrel 66 has a rectangular cross-section defined by the body portions 12*a* and 12*b*. The main planar portions of the body portions 12*a* and 12*b* form two opposing walls of the barrel 66, and internal ridges 68*a* and 68*b* formed on one or both of the body portions 12*a* and 12*b* form the other two opposing walls of the barrel 66. The barrel 66 has an intermediate opening 70 in the wall formed by the ridge 68*a*. That is, the ridge 68*a* does not extend unbroken from the magazine 58 to the exit end 22.

The drive wheel 26 is held in the position shown by the drive wheel biasing member 28 (see FIG. 1). When a projectile 14 is not in contact with the resilient part 48 of the drive wheel 26, the resilient part 48 intrudes into the barrel 66 though the intermediate opening 70 in a way that reduces the barrel height to a height that is smaller than the diameter of the projectile 14. When a projectile 14 comes into contact with the resilient part 48 of the drive wheel 26, the projectile 14 is kept in contact with the resilient part 48 by both its resilient conformance to the projectile 14 and by flexure of the drive wheel biasing member 28. The resulting traction developed on the projectile 14 by both the resiliency (and friction) of the resilient part 48 and the biasing of the drive wheel 26 into the barrel 66 by the drive wheel biasing member 28 propels the projectile 14 down the barrel 66. This is further explained below in relation to FIGS. 4*a-b*.

One or more non-driven wheels 72 can be provided opposite the drive wheel 26 in a second intermediate opening 74 in the barrel 66 and engage the projectile 14 as it passes thereby. When the drive wheel 26 engages the projectile 14, it applies a force to drive the projectile forward in the barrel 66 and also applies a force urging the projectile upwards. By having the projectile 14 be urged by the drive wheel 26 into non-driven wheels 72, there is much less frictional resistance to the forward motion of the projectile 14 than there would be if the non-driven wheels 72 were not provided and were replaced by a longer ridge 68*b*. The non-driven wheels 72 may intrude slightly into the barrel 66 so that the projectile 14 preferentially contacts the non-driven wheels 72 rather than the barrel wall defined by the ridge 68*b*.

Also visible in FIG. 3 is a cylindrical protrusion 76 of the rim 46 of the drive wheel 26. The protrusion 76 fits a complementary shaped recess in the body portion 12*a* to rotatably support the side of the drive wheel 26 opposite the drive wheel biasing member 28.

The trigger 38 can be pivotally connected to the body 12 at a pivot point 77. A spring 78 connected between the trigger 38 and the body portion 12*b* biases the trigger 38 forward. A rod 80 connects a pivot arm of the trigger 38 to a hammer 82 that is pivotally connected to the body 12 at a pivot point 84. When the trigger 38 is pulled, the rod 80 pulls the hammer 82 into contact with the next projectile 14 in the magazine 58 to push the projectile 14 down the barrel 66 and into contact with the resilient part 48 of the drive wheel 26. This firing position of the hammer 82 is shown in phantom line.

A switch 86 can be coupled to the trigger 38 to selectively supply power to the motor 42 to rotate the drive wheel 26. The switch 86 can be a contact switch composed of two metal contacts that when touching close a circuit. Wires 88 connect the switch 86 to the motor 42 and to a power source, such as batteries 90 located in a handle battery compartment 92. When the trigger 38 is pulled, the switch 86 closes and the batteries 90 power the motor 42 to spin the drive wheel 26. At about the same time, the hammer 82 pushes a projectile 14 into contact with the drive wheel 26.

In another example, a switch that is separate from the trigger 38 is used. The motor 42 can then be turned on and off independent of a trigger pull. Such a switch can be located on the motor housing 40 (see FIG. 2) or in the wall of the battery compartment 92, for example.

Figure 4A:
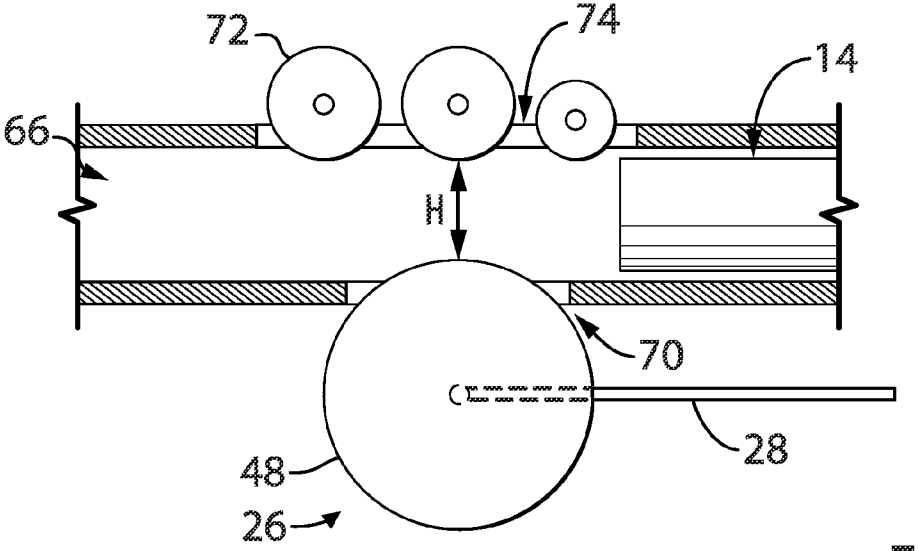
FIGS. 4*a-b* are diagrams showing operation of the drive wheel and the drive wheel biasing member.
Figure 4B:
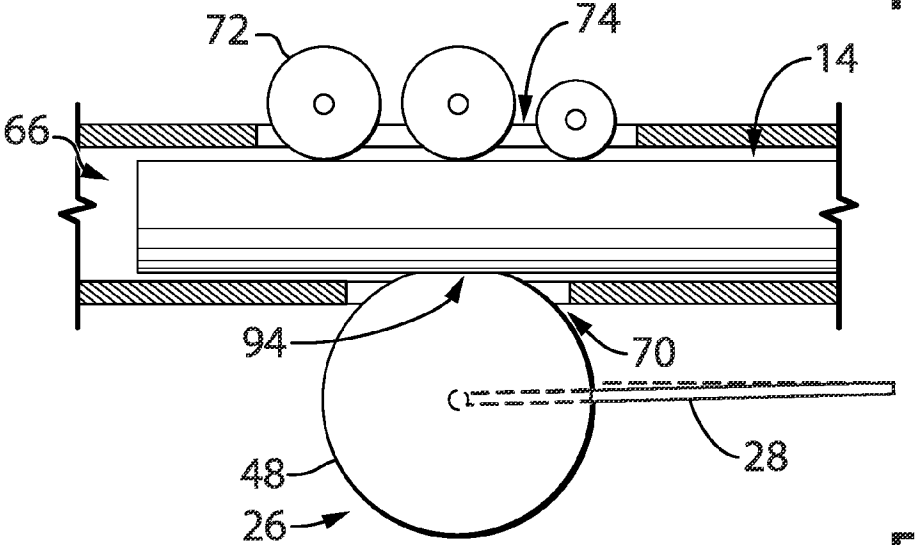

FIGS. 4*a-b* show operation of the resilient part 48 of the drive wheel 26 and the drive wheel biasing member 28.

FIG. 4*a* shows the projectile 14 not yet under the influence of the drive wheel 26. The drive wheel biasing member 28 positions the drive wheel 26 such that the resilient part 48 intrudes into the barrel 66 through the intermediate opening 70. The effective height H of the barrel 66 at the drive wheel 26 is thus less than the diameter of the projectile 14.

FIG. 4*b* shows the projectile 14 in contact with the resilient part 48 of the drive wheel 26. The resilient part 48 deforms at 94 to accommodate the relatively rigid projectile 14. This temporary deformation of part 48 increases the mutual contact area of the resilient part 48 and the projectile 14 as compared to a rigid drive wheel, thus permitting a greater force to be exerted by the drive wheel 26 on the projectile 14 with less slippage therebetween, enabling a greater degree of acceleration to be imparted to the projectile 14 over an arrangement with a rigid wheel. The resilient part 48 may also expand when spun, and thereby deform due to a resulting centrifugal force. This can causes greater conformity of the resilient part 48 to the projectile 14, which can reduce slippage of the resilient part 48 against the projectile 14. In addition, the drive wheel biasing member 28 urges the drive wheel 26 into engagement with the projectile 14 with a selected force to provide relatively consistent engagement between the drive wheel and projectiles 14 of different diameters. Furthermore, the biasing member 28 permits the drive wheel 26 to maintain good engagement with the projectile 14 while accommodating any irregularities on the projectile (not shown), or changes in the diameter of the projectile 14.

Figure 5:
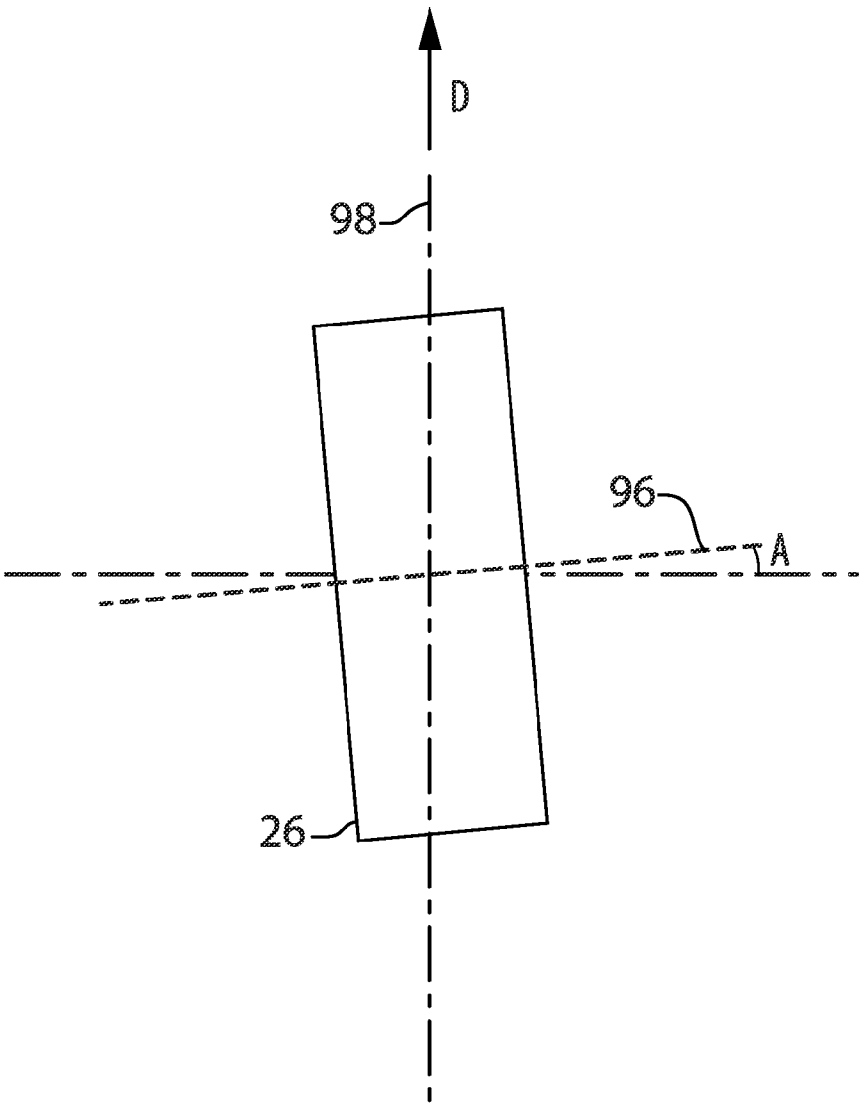
FIG. 5 is a diagram showing an angle of the drive wheel.

As shown in FIG. 5, the drive assembly 24 can be installed at an angle to impart spin to the projectile 14. In this figure, the drive wheel 26 of the drive assembly 24 is shown as if looking down into the barrel 66 through the second intermediate opening 74.

By angling the drive assembly 24 by a predetermined angle A, the axis of rotation 96 of the drive wheel 26 is made to deviate from being perpendicular to the length of the barrel 66, which is indicated by line 98. This arrangement can impart spin to the projectile 14 about its central axis, which lies parallel to line 98, when the drive wheel 26 propels the projectile 14 in the launch direction D. The amount of spin can be set by selecting specific values for the predetermined angle A. Examples of predetermined angles include the range from 1 to 10 degrees. Providing spin to the projectile 14 can contribute to the accuracy with which the projectile 14 can be fired at a target.

Figure 6:
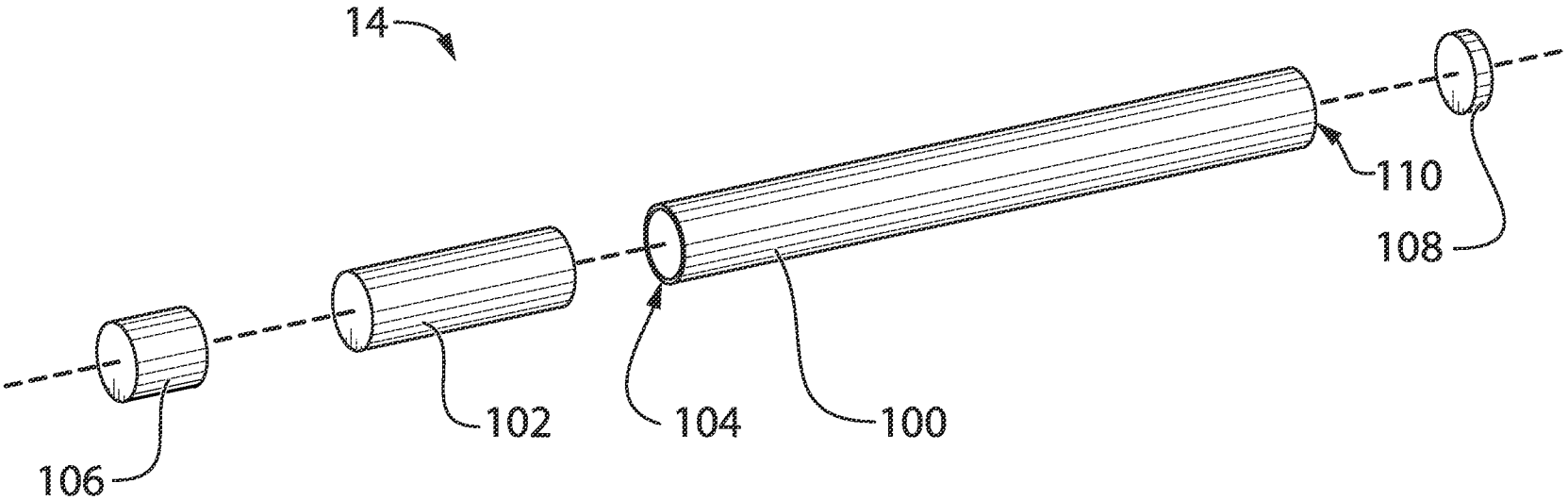
FIG. 6 is an exploded perspective view of the projectile.

FIG. 6 illustrates an example of the toy projectile 14. The projectile 14 is generally cylindrical and has a central axis indicated by the centerline shown. The projectile 14 may also be known as a dart or missile.

The projectile 14 includes a hollow body 100, which may be generally cylindrical, as shown. The hollow body 100 can be made of an extruded plastic tube, similar to a drinking straw. A weight 102, such as a solid piece of plastic or dense foam, can be disposed inside the hollow body 100 at a fore end 104 of the hollow body 100. The weight 102 can help the projectile 14 fly with the fore end 104 leading. In addition, the inertia provided by the weight 102 can further help maintain spin of the projectile 14 about its central axis.

Use of a relatively rigid material for the hollow body 100 can allow the projectile 14 to weigh less than a comparable projectile made mainly or wholly of foam. A lower weight can allow for a higher speed (and thus range) without a resulting increase in momentum and kinetic energy and therefore without a resulting increase in the likelihood of injury to a person struck by the projectile. Moreover, the relative rigidness of the hollow body 100 can serve to limit flexing of the projectile 14 during flight when compared to foam projectiles. Less flex during flight can mean less drag, more accuracy, and greater range.

A soft, but preferably resilient, fore cap 106 can be attached to the fore end 104 of the hollow body 100. To secure the resilient fore cap 106 in place, the cap 106 can be partially inserted into the fore end 104. Alternatively, the cap 106 can abut the fore end 104 and be held in place by an adhesive. The cap 106 can be a solid cylindrical piece of foam, or other soft or resilient material, which can help prevent injury to a person accidentally hit by the projectile 14. In another example, the cap 106 can be shaped as a cone or hemisphere.

An aft cap 108 can be attached at an aft end 110 of the hollow body 100. The aft cap 108 can be similar to the fore cap 106, and as such can also be made of resilient material. In this example, the aft cap 108 is not as long as the fore cap 106.

Each of the weight 102 and caps 106 and 108 can be held to the hollow body 100 by a friction fit, an adhesive, or another technique.

With reference to FIG. 6, a method of making the toy projectile 14 can include the following steps. A section is cut from a length of extruded tube to create a hollow body 100, which may be cylindrical, as shown. A weight 102, which can be cut from a length of plastic or foam rod, is fitted into a fore end 104 of the section of tube. The fore end 104 of the section of tube is then plugged by the resilient fore cap 106, which can be cut from a length of foam stock. If desired, an aft end 110 of the section of tube can be plugged by an aft cap 108.

Figure 7:
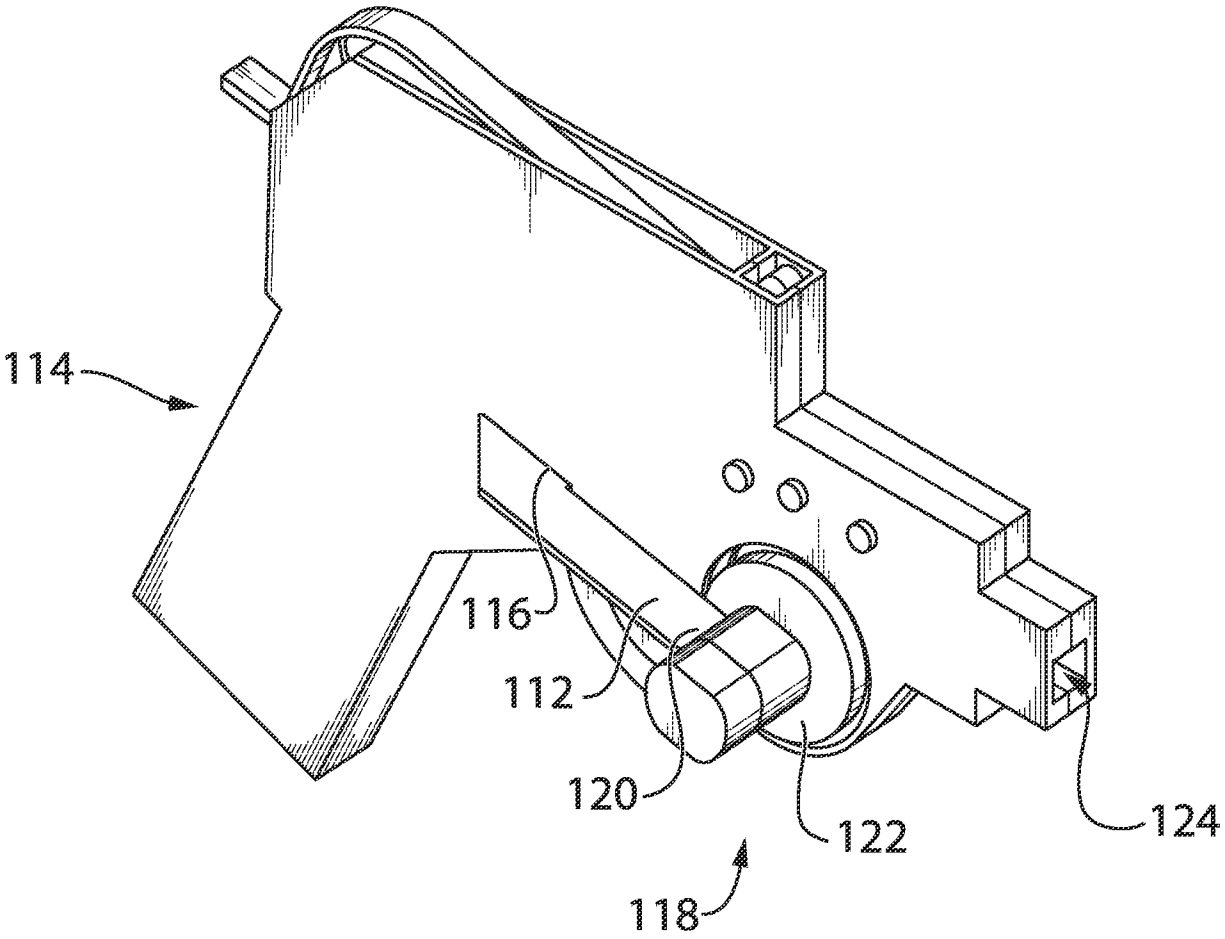
FIG. 7 is a perspective view of alternative example of a drive wheel biasing member.

FIG. 7 shows an alternative example of a drive wheel biasing member. The drive wheel biasing member 112 is rigidly connected to a body 114 of a toy projectile launcher, such as the launcher 10 described above, at one end 116. A drive assembly 118, which can be similar or identical to the drive assembly 24 described above, is fixed to the other end 120 of the drive wheel biasing member 112. The drive assembly 118 is thus cantilevered from the drive wheel biasing member 112 at a position that tends to cause a portion of a drive wheel 122 of the drive assembly 118 to intrude into the barrel 124 of the launcher to contact and propel a projectile down the barrel 124. For further discussion of the launcher depicted in FIG. 7, the above-described launcher 10 can be referenced.

Figure 8:
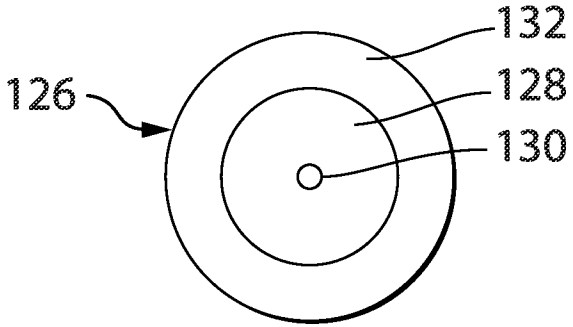
FIG. 8 is a side view of an alternative example of a drive wheel.

FIG. 8 shows an alternative example of a drive wheel as viewed from the side. The drive wheel 126 can be used in the toy projectile launcher 10 in place of the drive wheel 26. The drive wheel 126 includes a cylindrical spindle 128, which can be made of hard plastic. The spindle 128 includes a hole 130 for connection to the shaft 43 of the motor 42. A ring-shaped resilient part 132 surrounds an outside cylindrical surface of the spindle 128. The resilient part 132 can be attached to the spindle 128 using a friction fit or an adhesive. The resilient part 132 can be made of any of the materials described above for the resilient part 48.

Figure 9A:
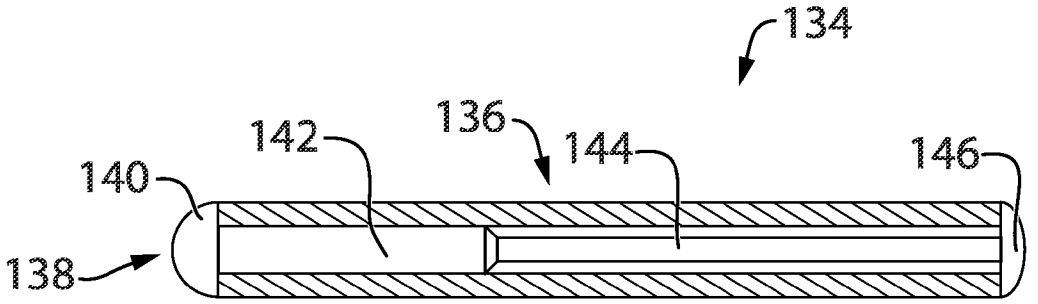
FIGS. 9*a-b* are partial cross-sectional views of another example of a projectile.
Figure 9B:
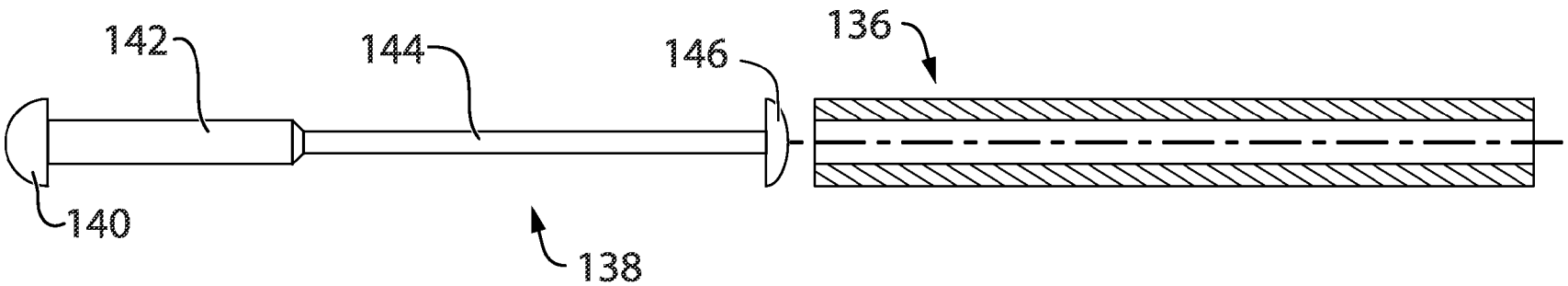

FIGS. 9*a-b* show another example of a projectile 134 that can be used with the toy projectile launcher 10. The projectile 134 is similar to the projectile 14, and the above description can be referenced.

In FIG. 9*a*, the projectile 134 is shown assembled. The projectile 134 includes a hollow body 136, which may be cylindrical, as shown, which can be made of an extruded plastic tube. An elongate insert piece 138 is situated within the hollow cylindrical body 136. The insert piece 138 is soft or resilient and has ends larger than the inside diameter of the hollow body 136. The larger ends prevent the insert piece 138 from leaving the hollow body 136 during normal use.

The insert piece 138 is of varying axial cross-section and includes at least four portions, namely, a fore cap 140, a weight 142, a stem 144, and an aft cap 146. The insert piece 138 can be made of foam or other soft or resilient material. In this example, the insert piece 138 is made from a single piece of material.

The fore cap 140 and aft cap 146 are each larger than the inside dimensions of the hollow body 136 and abut the ends of the body 136 to hold the insert piece 138 inside the body 136. The fore and aft caps 140, 146 can be of the same shape or of different shapes. In this example, the fore cap 140 is larger than the aft cap 146, which can assist in identifying the forward end of the projectile 134.

The weight 142 is a portion of the insert piece 138 that is located near and connected to the fore cap 140 and that has a diameter larger than the stem 144, and as such positions the center of gravity of the projectile 134 towards the fore cap 140 to provide longitudinal stability during flight. The stem 144 serves to connect the aft cap 146 to the weight 142.

FIG. 9*b* shows the projectile 134 disassembled. Since the insert piece 138 is made of soft or resilient material, it can be pulled through the relatively rigid hollow body 136. As the insert piece 138 is pulled into or out of the hollow body 136, the insert piece 138 can resiliently deform. During assembly of the projectile 134, when the insert piece 138 is pulled into the hollow body 136 by, for example, a wire temporarily attached to the aft cap 146, the aft cap 146 resiliently deforms as it is pulled through the narrower hollow body 136. Once the weight 142 is fitted in place and the aft cap 146 emerges from the end of the holly cylindrical body 136, the aft cap 146 regains its shape and cooperates with the fore cap 140, which now plugs the fore end of the body 136, to hold the insert piece 138 inside the body 136.

While the foregoing provides certain non-limiting example embodiments, it should be understood that combinations, subsets, and variations of the foregoing are contemplated. The monopoly sought is defined by the claims.

What is claimed is:

1. A toy projectile launcher comprising:

a body having a magazine for storing at least one projectile, the body having an elongate barrel in communication with the magazine, the barrel being shaped for travel of the projectile from the magazine to an exit end of the barrel, the barrel having an intermediate opening between the magazine and the exit end;

a drive assembly having:

a motor; and a drive wheel coupled to the motor; and a drive wheel biasing member coupling the drive assembly to the body, the drive wheel biasing member positioning the drive wheel such that drive wheel extends into the barrel though the intermediate opening and wherein the drive wheel biasing member biases the drive wheel towards engagement with the projectile when the projectile is in the barrel.

2. The toy projectile launcher of claim 1, wherein the drive wheel biasing member has a first end and a second end, and is pivotally connected to the body between a first end and the second end, and wherein the drive wheel biasing member is coupled to the drive assembly at the first end and the second end is engageable with a limit surface on the body.

3. The toy projectile launcher of claim 1, further comprising at least one non-driven wheel each having a peripheral edge that generally faces the drive wheel, wherein the spacing in a direction that is transverse to a longitudinal axis of the barrel between the at least one non-driven wheel and the drive wheel when the drive wheel biasing member is in a rest position is less than the width of the at least one projectile.

4. The toy projectile launcher of claim 1, wherein an axis of rotation of the drive wheel deviates from being perpendicular to a longitudinal axis of the barrel by a predetermined angle.

5. The toy projectile launcher of claim 1, wherein the motor is directly connected to the drive wheel.

6. The toy projectile launcher of claim 1, wherein the motor is the only motor provided.

7. The toy projectile launcher of claim 1, wherein the drive wheel comprises a resilient part for contacting the projectile and wherein the resilient part of the drive wheel conforms to the shape of the projectile when in contact with the projectile.

8. The toy projectile launcher of claim 1, further comprising a trigger coupled to the body, the trigger movable to bring a hammer into contact with the projectile to push the projectile into contact with the drive wheel.

9. The toy projectile launcher of claim 8, further comprising a switch coupled to the trigger, the switch for supplying power to the motor when the trigger is pulled.

10. The toy projectile launcher of claim 1, further comprising a magazine feed member coupled to the body, the magazine feed member biased to urge projectiles towards the barrel.

11. A toy projectile launcher comprising:

a body having a magazine for storing at least one cylindrical projectile having a central axis, the body having an elongate barrel in communication with the magazine, the barrel being shaped for travel of the projectile from the magazine to an exit end of the barrel, the barrel having an intermediate opening between the magazine and the exit end;

a motor coupled to the body;

a drive wheel coupled to the motor, an axis of rotation of the drive wheel deviating from being perpendicular to the length of the barrel by a predetermined angle, the drive wheel intruding into the barrel though the intermediate opening to contact and propel the projectile down the barrel, the predetermined angle selected to impart spin to the projectile about the central axis; and a drive wheel biasing member that couples the motor and drive wheel to the body, the drive wheel biasing member biasing the drive wheel into contact with the projectile.

12. The toy projectile launcher of claim 11, wherein the drive wheel comprises a resilient part for contacting the projectile.

* * * * *

UNITED STATES PATENT AND TRADEMARK OFFICE

CERTIFICATE OF CORRECTION

PATENT NO. : 8,955,503 B2
APPLICATION NO. : 13/288484
DATED : February 17, 2015
INVENTOR(S) : Jeffrey J. Corsiglia et al.

It is certified that error appears in the above-identified patent and that said Letters Patent is hereby corrected as shown below:

On the title page item (57) Abstract, Line 10, delete the words "though the intermediate" and replace with --through the intermediate--.

In the Specification

Col. 1, Line 52, delete "though the intermediate" and replace with --through the intermediate--;

Col. 2, Line 23, delete "though the intermediate" and replace with --through the intermediate--;

Col. 4, Line 56, delete "though the intermediate" and replace with --through the intermediate--;

In the Claims

Col. 8, Claim 1, Line 28, delete "that drive wheel" and replace with --that the drive wheel--;

Col. 8, Claim 1, Line 29, delete "though the intermediate" and replace with --through the intermediate--;

Col. 9, Claim 11, Line 13, delete "though the intermediate" and replace with --through the intermediate--.

Signed and Sealed this
First Day of September, 2015

Michelle K. Lee

Michelle K. Lee
*Director of the United States Patent and Trademark Office*